US010290442B2

(12) United States Patent
Yashima et al.

(10) Patent No.: US 10,290,442 B2
(45) Date of Patent: May 14, 2019

(54) PUSH SWITCH

(71) Applicant: ALPS ALPINE CO., LTD., Tokyo (JP)

(72) Inventors: Yuki Yashima, Miyagi (JP); Izuru Sadamatsu, Miyagi (JP); Toshihiko Tazawa, Miyagi (JP)

(73) Assignee: ALPS ALPINE CO., LTD., Tokyo (JP)

( * ) Notice: Subject to any disclaimer, the term of this patent is extended or adjusted under 35 U.S.C. 154(b) by 0 days.

(21) Appl. No.: 15/705,702

(22) Filed: Sep. 15, 2017

(65) Prior Publication Data

US 2018/0005777 A1 Jan. 4, 2018

Related U.S. Application Data

(63) Continuation of application No. PCT/JP2016/063080, filed on Apr. 26, 2016.

(30) Foreign Application Priority Data

May 9, 2015 (JP) ..... 2015-096109

(51) Int. Cl.
*H01H 13/14* (2006.01)
*H01H 13/48* (2006.01)
(Continued)

(52) U.S. Cl.
CPC ..... *H01H 13/14* (2013.01); *H01H 13/20* (2013.01); *H01H 13/48* (2013.01);
(Continued)

(58) Field of Classification Search
CPC .. H01H 13/14; H01H 13/20; H01H 2215/004; H01H 2233/07
(Continued)

(56) References Cited

U.S. PATENT DOCUMENTS 4,127,758 A 11/1978 Lowthorp
2002/0130024 A1* 9/2002 Kawaguchi ..... H01H 13/702 200/512
(Continued)

FOREIGN PATENT DOCUMENTS

JP H07-007038 U 1/1995
JP H07-029728 U 6/1995
(Continued)

OTHER PUBLICATIONS

International Search Report dated Jul. 26, 2016 in PCT/JP2016/063080 filed on Apr. 26, 2016.
(Continued)

*Primary Examiner* — Renee S Luebke
*Assistant Examiner* — Iman Malakooti
(74) *Attorney, Agent, or Firm* — IPUSA, PLLC

(57) ABSTRACT

A push switch includes a movable contact including a dome part that is shaped like a dome and configured to be inverted in shape when pressed, and a fixed contact including a first fixed contact, the movable contact being configured to be brought into contact with and away from the first fixed contact. The push switch is configured such that an operating load necessary to press the movable contact gradually increases after the movable contact starts to be pressed, decreases thereafter when the dome part is inverted, and increases again when the movable contact is further pressed, and the dome part contacts the first fixed contact after an inflection point at which the decreased operating load starts to increase again.

3 Claims, 11 Drawing Sheets

(51) Int. Cl.
*H01H 13/20* (2006.01)
*H01H 13/70* (2006.01)
*H01H 13/85* (2006.01)

(52) U.S. Cl.
CPC ..... *H01H 13/7006* (2013.01); *H01H 13/85* (2013.01); *H01H 2215/004* (2013.01); *H01H 2215/012* (2013.01); *H01H 2215/018* (2013.01); *H01H 2215/022* (2013.01); *H01H 2215/028* (2013.01); *H01H 2227/0261* (2013.01); *H01H 2227/034* (2013.01); *H01H 2233/07* (2013.01)

(58) Field of Classification Search
USPC ..... 200/341
See application file for complete search history.

(56) References Cited

U.S. PATENT DOCUMENTS

| | | | | |
|---|---|---|---|---|
| 2006/0131153 | A1* | 6/2006 | Asada | H01H 13/48 200/341 |
| 2011/0203912 | A1* | 8/2011 | Niu | H01H 3/125 200/341 |
| 2014/0190810 | A1 | 7/2014 | Krumpelman et al. | |

FOREIGN PATENT DOCUMENTS

| | | | | |
|---|---|---|---|---|
| JP | H08-083532 | | 3/1996 | |
| JP | 2003-123566 | | 4/2003 | |
| JP | 2003123566 | * | 4/2003 | H01H 5/30 |
| JP | 2005-019112 | | 1/2005 | |
| JP | 2005019112 | * | 1/2005 | H01H 13/10 |
| JP | 2005-044552 | | 2/2005 | |
| JP | 2008-159512 | | 7/2008 | |
| JP | 2010-186580 | | 8/2010 | |
| JP | 2014-013672 | | 1/2014 | |
| JP | 2014-220130 | | 11/2014 | |
| JP | 2015-002024 | | 1/2015 | |
| JP | 2017-079133 | | 4/2017 | |
| WO | 2017/056601 | | 4/2017 | |

OTHER PUBLICATIONS

Extended European Search Report for 16792554.4 dated May 9, 2018.

Office Action dated Nov. 27, 2018 issued with respect to the corresponding Japanese Patent Application No. 2017-517872.

* cited by examiner

PUSH SWITCH

CROSS-REFERENCE TO RELATED APPLICATIONS

The present application is a continuation application filed under 35 U.S.C. 111(a) claiming benefit under 35 U.S.C. 120 and 365(c) of PCT International Application No. PCT/JP2016/063080, filed on Apr. 26, 2016, which is based on and claims the benefit of priority of Japanese Patent Application No. 2015-096109 filed on May 9, 2015, the entire contents of which are incorporated herein by reference.

BACKGROUND OF THE INVENTION

1. Field of the Invention

An aspect of this disclosure relates to a push switch.

2. Description of the Related Art

Japanese Laid-Open Patent Publication No. 2014-013672, for example, discloses a push switch having a click feel.

FIG. 10 is an exploded perspective view of a push switch 100 disclosed in Japanese Laid-Open Patent Publication No. 2014-013672. FIGS. 11A and 11B are cross-sectional views of the related-art push switch 100. FIG. 11A is a cross-sectional view illustrating an initial state where the push switch 100 is not being pressed. FIG. 11B is a cross-sectional view illustrating a state where the push switch 100 is being pressed.

As illustrated in FIG. 10, the push switch 100 includes a movable contact 101 including a round part 101*a* having a dome shape, a housing 102 including a recess 102*a* for housing the movable contact 101 and a fixed contact 103 to be brought into contact with the movable contact 101, and a sheet 104 including a pressed part 104*a* that covers the recess 102*a* of the housing 102 and is pressed from the outside.

As illustrated in FIG. 11A, before the push switch 100 is pressed, the round part 101*a* of the movable contact 101 is not inverted in shape, and a first fixed contact 103*a* and second fixed contacts 103*b* are not electrically connected to each other. In the state of FIG. 11A, when the pressed part 104*a* of the sheet 104 is pressed in the Z2 direction by a pressing part OP of an electronic apparatus where the push switch 100 is installed, the round part 101*a* of the movable contact 101 is pressed via the sheet 104 as illustrated in FIG. 11B. The pressed round part 101*a* sags in the Z2 direction and is inverted in shape, and contacts the first fixed contact 103*a*. When the round part 101*a* contacts the first fixed contact 103*a*, the first fixed contact 103*a* and the second fixed contacts 103*b* are electrically connected to each other via the movable contact 101.

The push switch 100 is configured such that the round part 101*a* collides with the fixed contact 103 before the round part 101*a* is completely inverted.

However, a push switch such as the push switch 100 having a click feel has a problem where a sound is generated when the push switch is turned on. The main causes of the operation sound generated when the push switch is turned on are supposed to be a collision sound that is generated when the round part 101*a* of the movable contact 101 collides with the first fixed contact 103*a* and the vibration of the round part 101*a*. Accordingly, the operation sound increases as the force of inversion of the round part 101*a* increases. Thus, there is a problem that the operation sound increases as the click feel is made clearer, and it is difficult to provide a switch with a small operation sound.

SUMMARY OF THE INVENTION

In an aspect of this disclosure, there is provided a push switch that includes a movable contact including a dome part that is shaped like a dome and configured to be inverted in shape when pressed, and a fixed contact including a first fixed contact, the movable contact being configured to be brought into contact with and away from the first fixed contact. The push switch is configured such that an operating load necessary to press the movable contact gradually increases after the movable contact starts to be pressed, decreases thereafter when the dome part is inverted, and increases again when the movable contact is further pressed, and the dome part contacts the first fixed contact after an inflection point at which the decreased operating load starts to increase again.

DESCRIPTION OF THE PREFERRED EMBODIMENTS

Figure 1:
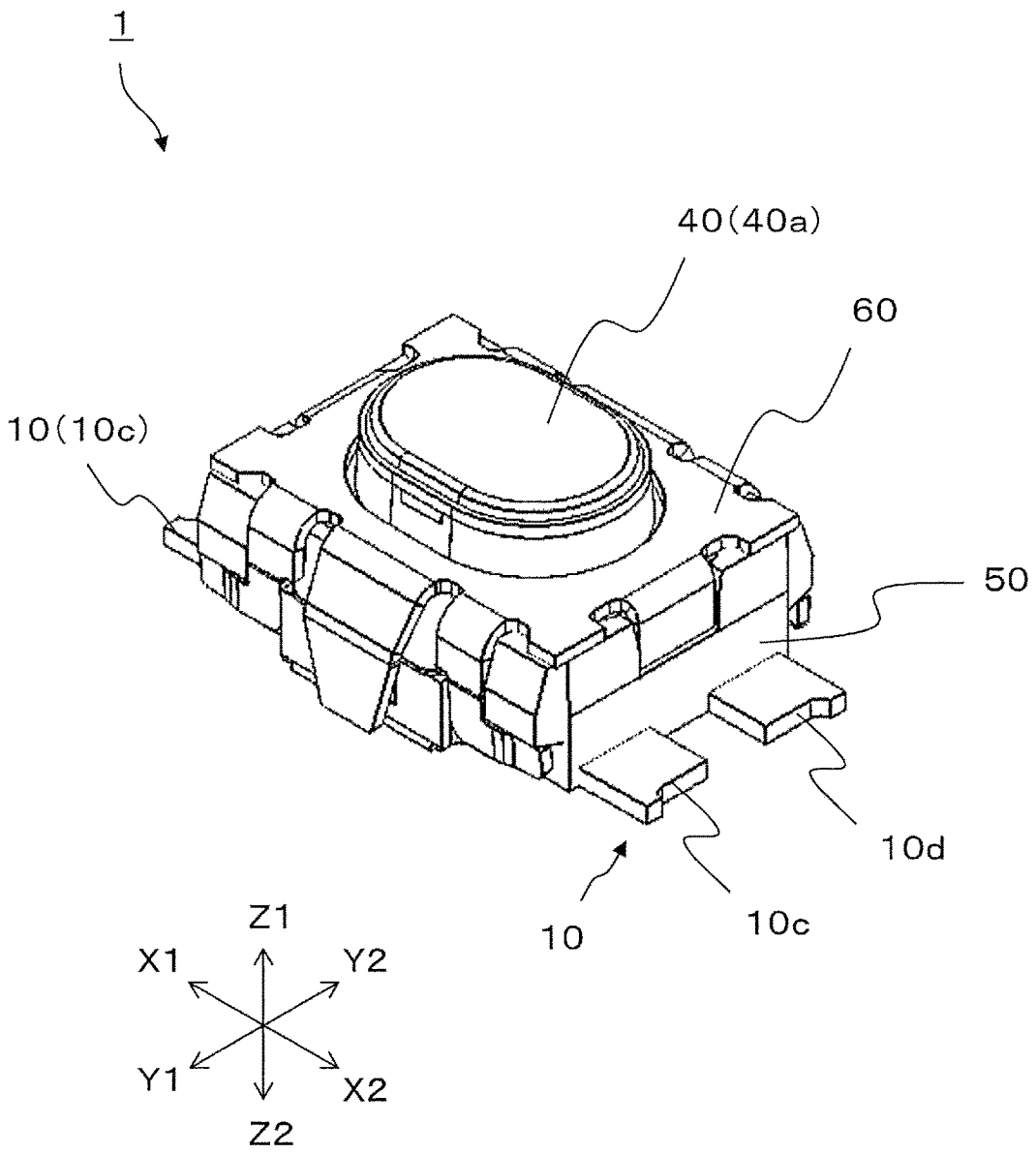
FIG. 1 is a perspective view of a push switch according to an embodiment of the present invention.

One object of this disclosure is to solve the above-described problem and to provide a push switch with a good click feel as well as a small operation sound.

An embodiment of the present invention is described below with reference to the accompanying drawings. For clarity, dimensions of components in the drawings are changed as necessary.

Figure 2:
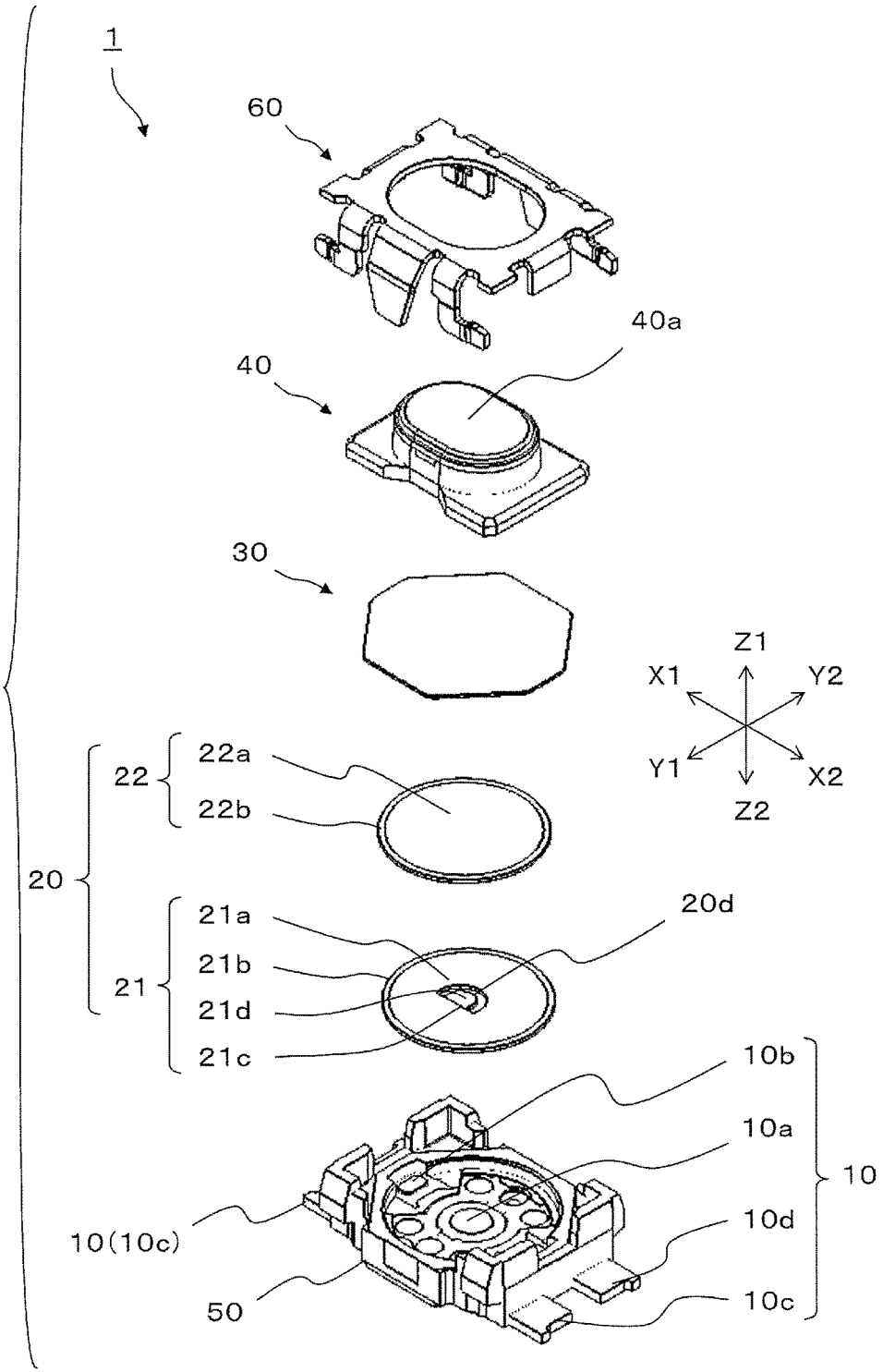
FIG. 2 is an exploded perspective view of a push switch according to an embodiment of the present invention.
Figure 3:
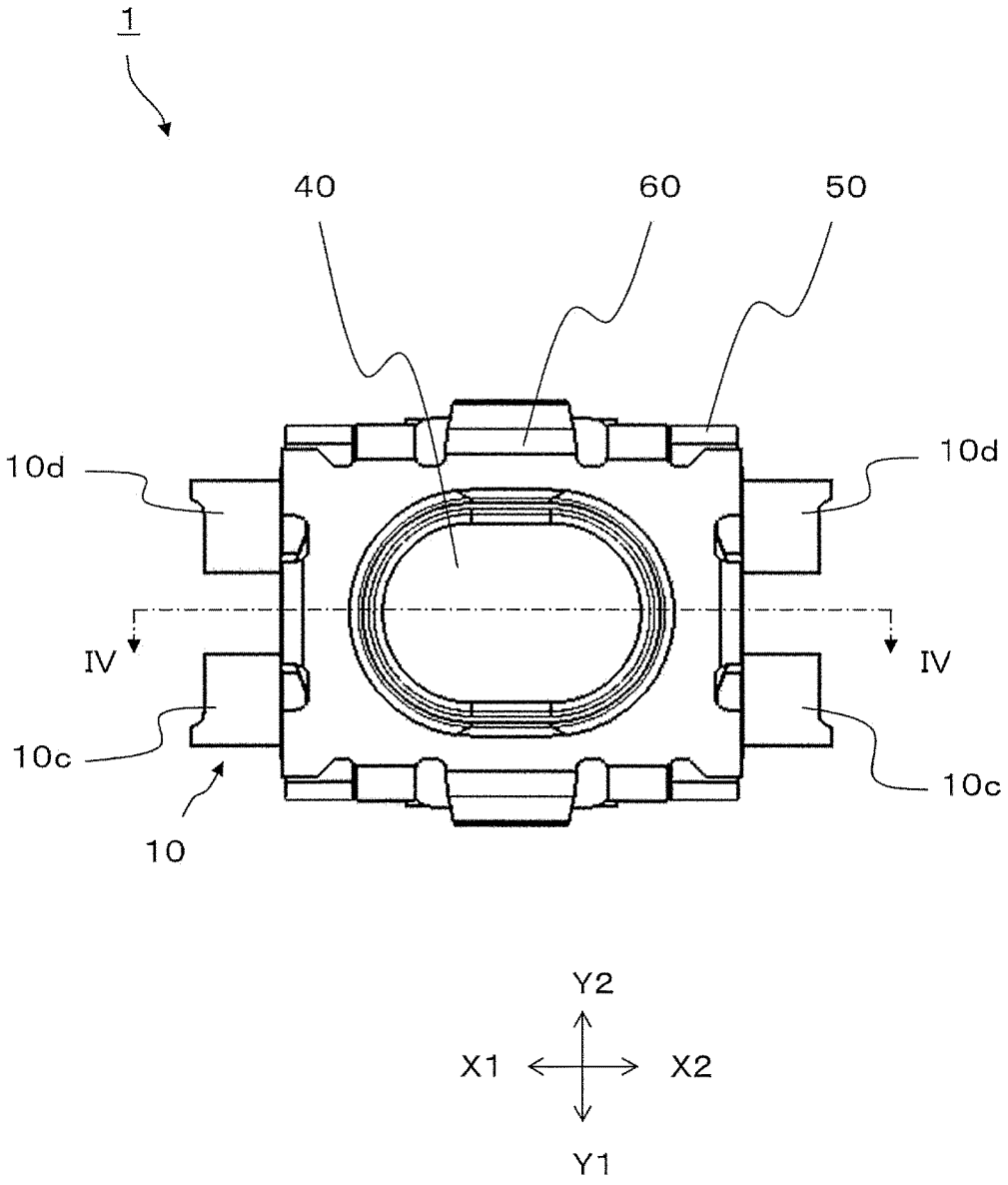
FIG. 3 is a plan view of a push switch according to an embodiment of the present invention.
Figure 4:
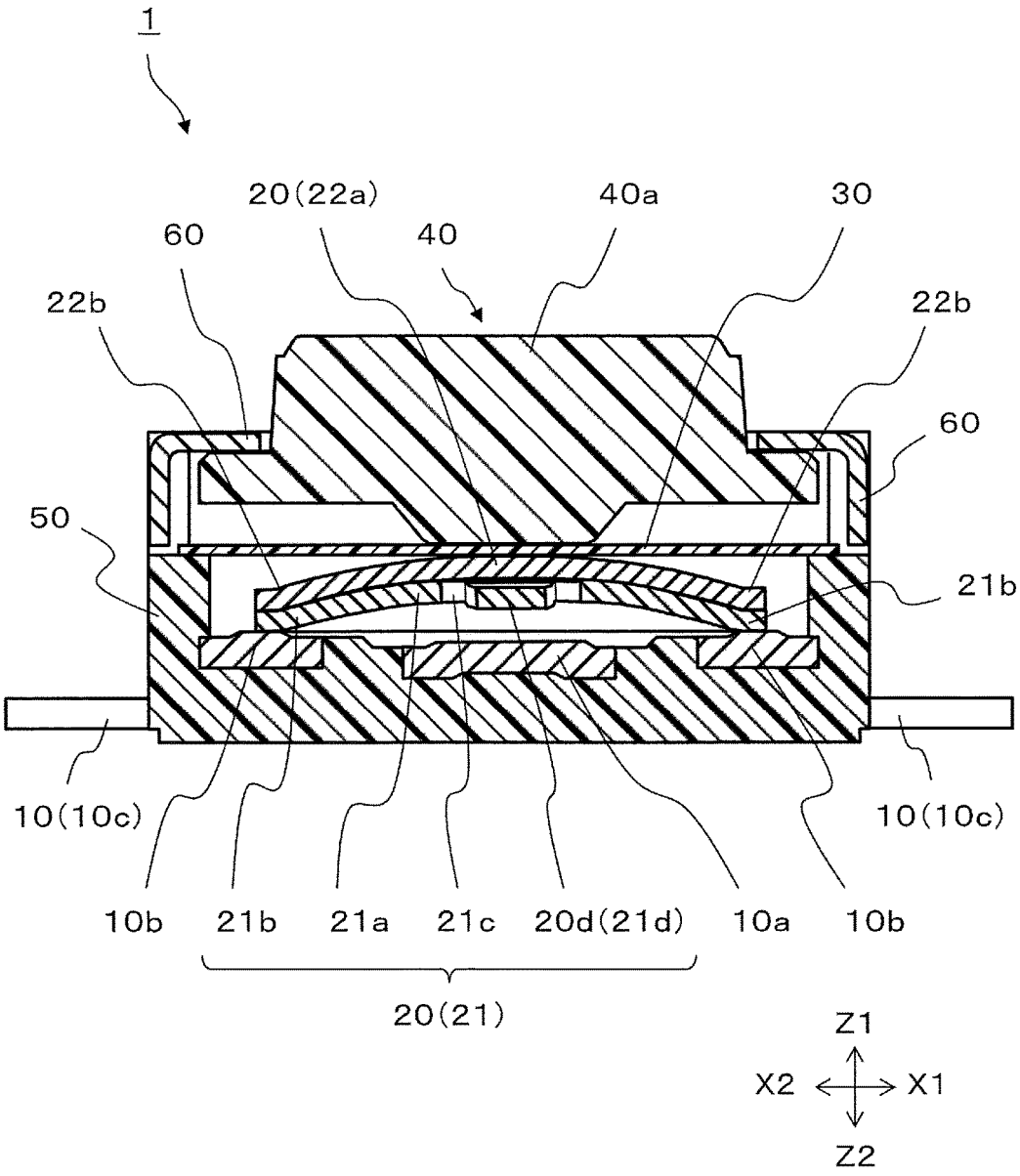
FIG. 4 is a cross-sectional view taken along line IV-IV of FIG. 3.
Figure 5:
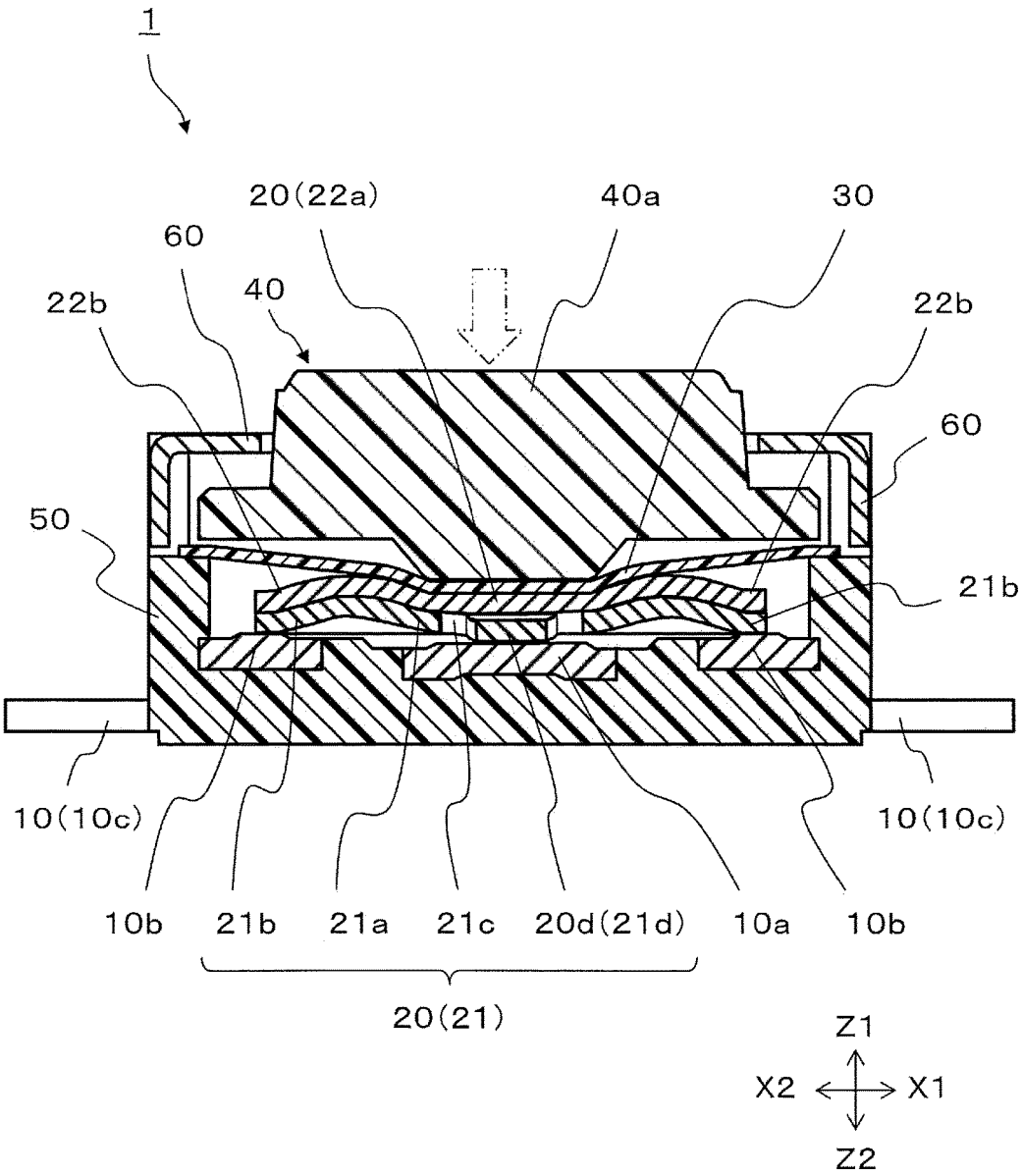
FIG. 5 is a drawing illustrating a state where inversion of a dome part in the cross section of FIG. 4 is completed.
Figure 6:
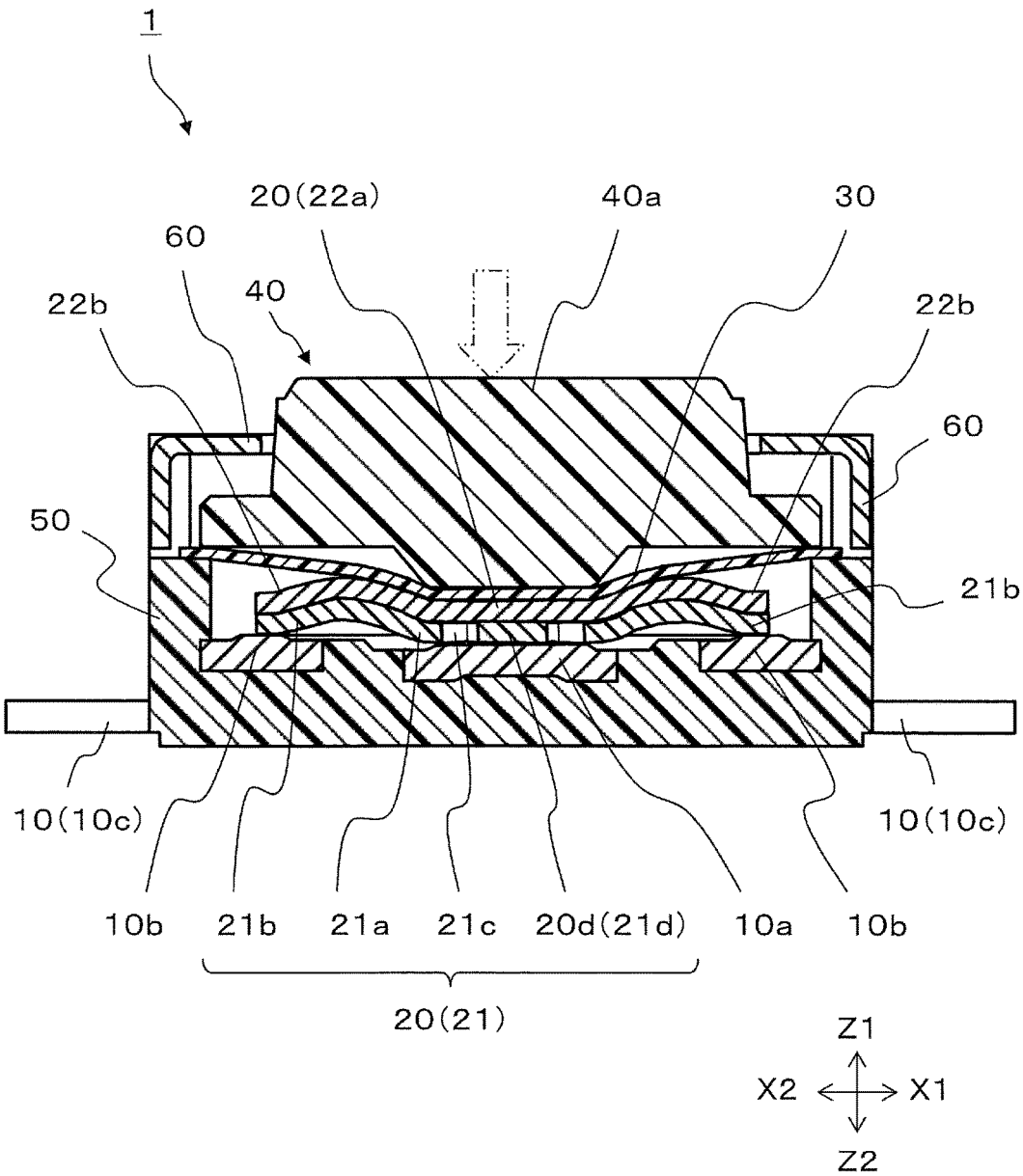
FIG. 6 is a drawing illustrating a state where the dome part is further pressed from the state in FIG. 5.

FIG. 1 is a perspective view of a push switch 1 according to an embodiment of the present invention. FIG. 2 is an exploded perspective view of the push switch 1. FIG. 3 is a plan view of the push switch 1. FIG. 4 is a cross-sectional view taken along line IV-IV of FIG. 3. FIG. 5 is a drawing illustrating a state where inversion of a dome part 21*a* in the cross section of FIG. 4 is completed. FIG. 6 is a drawing illustrating a state where the dome part 21*a* is further pressed from the state in FIG. 5.

As illustrated by FIGS. 1 through 4, the push switch 1 of the present embodiment includes a housing 50, a fixed contact 10, a movable contact 20, a sheet 30, an operation part 40, and a cover 60.

The housing 50 is formed by injection-molding an insulating synthetic resin. As illustrated in FIGS. 2 and 4, the fixed contact 10 is embedded in the housing 50, and a housing space for housing the movable contact 20 is formed in the housing 50.

The fixed contact 10 is formed by machining a conductive metal plate. The fixed contact 10 includes a first fixed contact 10*a* that is disposed in the middle of the housing 50 such that the Z1 side of the first fixed contact 10*a* is exposed, and second fixed contacts 10*b* that are disposed apart from and around the fixed contact 10*a*. The first fixed contact 10*a* is connected to terminals 10*c* that protrude from the X1 and X2 ends of the housing 50. The second fixed contacts 10*b* are connected to terminals 10*d* that protrude from the X1 and X2 ends of the housing 50. In the initial state of the push switch 1, the terminals 10*c* and the terminals 10*d* are electrically insulated from each other.

The movable contact 20 is formed by machining a conductive metal plate. In the push switch 1 of the present embodiment, the movable contact 20 includes a first movable contact 21 and a second movable contact 22 that are stacked on each other. Alternatively, the movable contact 20 may include only the first movable contact 21.

The first movable contact 21 includes a dome part 21*a* that is shaped like a dome and can be inverted in shape when pressed, a skirt 21*b* that continuously surrounds and extends outward from the circumference of the dome part 21*a*, and a tongue part 21*d* that is shaped like a plate spring and formed near a top part 21*c* of the dome part 21*a*. As described below, the tongue part 21*d* functions as a contact part 20*d* that can elastically contact the first fixed contact 10*a*.

The second movable contact 22 includes a dome part 22*a* that is shaped like a dome and can be inverted in shape when pressed, and a skirt 22*b* that continuously surrounds and extends outward from the circumference of the dome part 22*a*. As illustrated in FIG. 4, the second movable contact 22 is shaped to fit over the first movable contact 21, and functions together with the first movable contact 21.

The sheet 30 is shaped like a sheet and formed of an insulating synthetic resin. The sheet 30 is disposed over the Z1 side of the movable contact 20 to cover the housing space of the housing 50 for housing the movable contact 20.

The operation part 40 is formed by injection-molding a synthetic resin, and is disposed to press the movable contact 20 via the sheet 30. The operation part 40 includes an operating part 40*a* that protrudes in the Z1 direction and is to be pressed by an operator.

The cover 60 is formed by machining a metal plate, and is disposed over the housing 50. The cover 60 covers the movable contact 20 and the sheet 30, and also covers the operation part 40 such that the operating part 40*a* is exposed through an opening of the cover 60. The cover 60 is attached to the side walls of the housing 50.

In the initial state, as illustrated in FIG. 4, the first fixed contact 10*a* is not in contact with the dome part 21*a* of the movable contact 20 (the first movable contact 21). The second fixed contacts 10*b* are in contact with the skirt 21*b* of the movable contact 20 (the first movable contact 21). In this initial state, the terminals 10*c* and the terminals 10*d* are not electrically connected with each other.

When an operator presses the operating part 40*a* in the Z2 direction, the operation part 40 causes the sheet 30 to sag and presses the dome part 22*a* in the Z2 direction. As a result, the sheet 30 and the dome parts 21*a* and 22*a* of the movable contact 20 are elastically deformed. When the pressing stroke amount reaches a predetermined amount (a maximum load position P1 in FIG. 7), the dome parts 21*a* and 22*a* start to be inverted and are elastically deformed until the inversion is completed. In this state, as illustrated in FIG. 5, the push switch 1 of the present embodiment is configured such that only the contact part 20*d* (the tongue part 21*d*) contacts the first fixed contact 10*a*. When the operation part 40 is further pressed from this state, the dome part 21*a* contacts the first fixed contact 10*a* as illustrated in FIG. 6. In the state where the dome part 21*a* is in contact with the first fixed contact 10*a*, even when the operation part 40 is pressed further, the dome part 21*a* does not tend to be elastically deformed further and the operating load felt by the operator sharply increases.

The above configuration of the push switch 1 of the present embodiment is a difference from the related-art configuration. To more clearly explain the difference, the push switch 1 of the present embodiment is compared with a related-art push switch of a comparative example by referring to FIGS. 4 through 8.

Figure 7A:
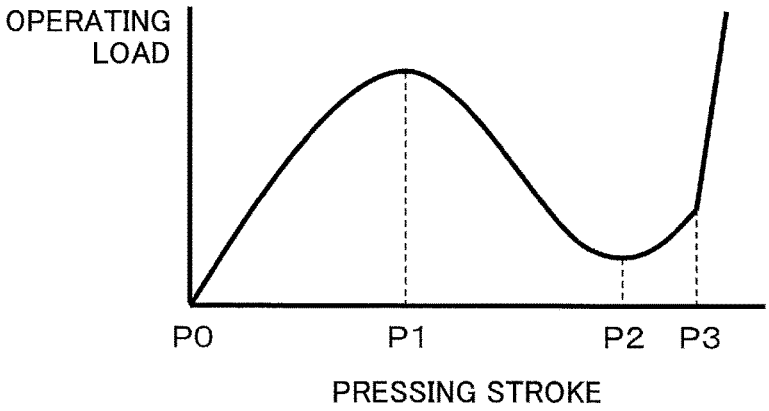
FIG. 7A is a drawing illustrating a relationship between a pressing stroke and an operating load felt by an operator of a push switch of an embodiment.
Figure 7B:
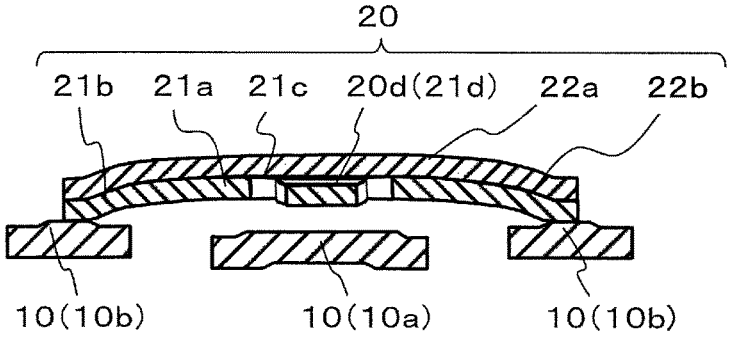
FIG. 7B is a cross-sectional view corresponding to a maximum load position.
Figure 7C:
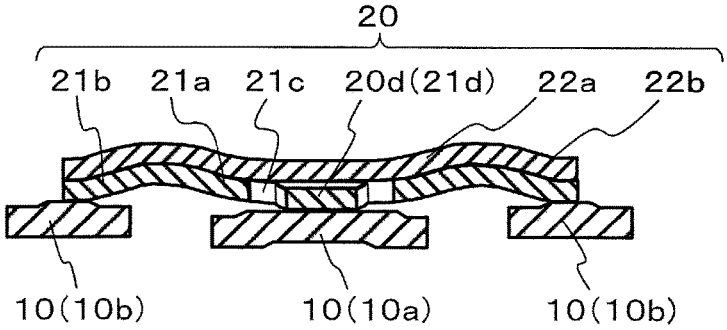
FIG. 7C is a cross-sectional view corresponding to a position where inversion of a dome part is completed.
Figure 7D:
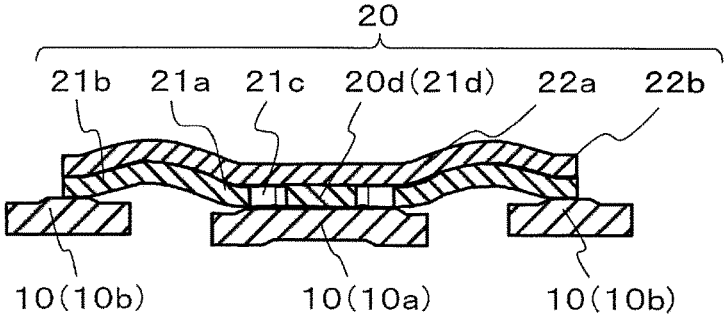
FIG. 7D is a cross-sectional view corresponding to a predetermined position to which the dome part is further pressed.
Figure 8A:
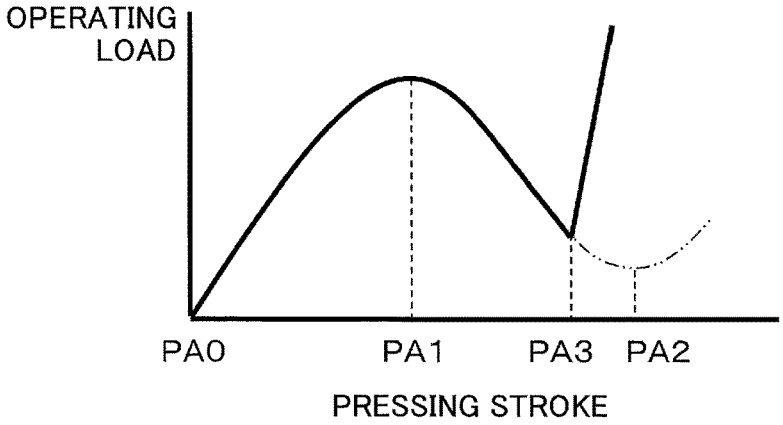
FIG. 8A is a drawing illustrating a relationship between a pressing stroke and an operating load felt by an operator of a related-art push switch of a comparative example.
Figure 8B:
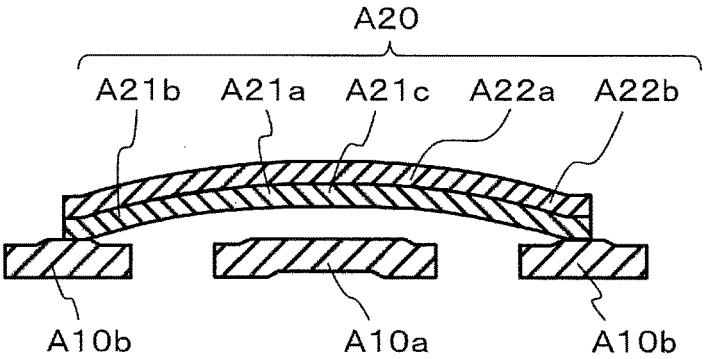
FIG. 8B is a cross-sectional view corresponding to a pressing stroke position in an initial state.
Figure 8C:
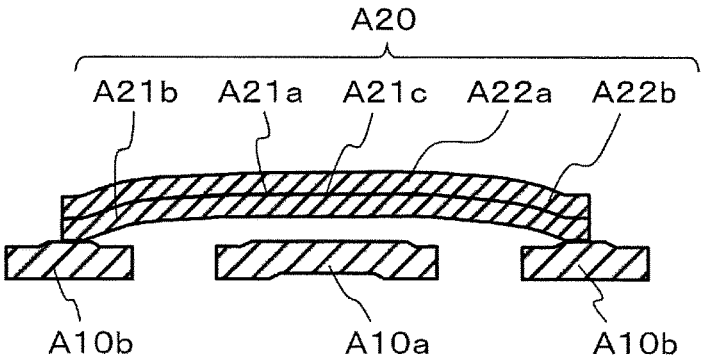
FIG. 8C is a cross-sectional view corresponding to a maximum load position.
Figure 8D:
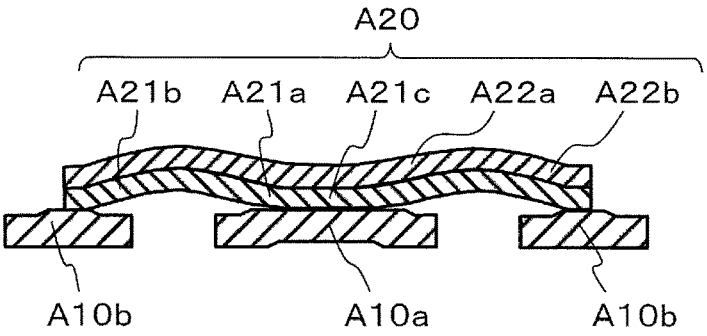
FIG. 8D is a cross-sectional view corresponding to a contact position of an inverted dome part.

FIGS. 7A through 7D are drawings illustrating operations of the push switch 1 of the present embodiment, FIG. 7A is a drawing illustrating a relationship between a pressing stroke and an operating load felt by an operator, FIG. 7B is a cross-sectional view corresponding to a maximum load position P1, FIG. 7C is a cross-sectional view corresponding to an inversion completion position P2 at which inversion of the dome part 21*a* is completed, and FIG. 7D is a cross-sectional view corresponding to a predetermined position P3 to which the dome part 21*a* is further pressed. FIGS. 8A through 8D are drawings illustrating operations of a related-art push switch of a comparative example, FIG. 8A is a drawing illustrating a relationship between a pressing stroke and an operating load felt by an operator, FIG. 8B is a cross-sectional view corresponding to a pressing stroke position PA0 in the initial state, FIG. 8C is a cross-sectional view corresponding to a maximum load position PA1, and FIG. 8D is a cross-sectional view corresponding to a contact position PA3 of an inverted dome part A21*a*.

As illustrated by FIG. 7A, with the push switch 1 of the present embodiment, the operating load felt by the operator nonlinearly changes as the position of the pressing stroke changes. The operating load at the pressing stroke position P0 in the initial state is 0. After the movable contact 20 starts to be pressed, the operating load necessary to press the movable contact 20 gradually increases. Then, the operating load decreases when the dome parts 21*a* and 22*a* are inverted and increases again when the movable contact 20 is pressed further. A relationship between pressing stroke positions and the states of elastic deformation of the movable contact 20, which causes changes in the operating load, is described in more detail below.

At the pressing stroke position P0 in the initial state, the movable contact 20 is not in contact with the first fixed contact 10*a* as illustrated in FIG. 4 and the push switch 1 is OFF.

When the operating part 40*a* (see FIG. 4) is pressed, the operating load increases along with the elastic deformation of the dome parts 21*a* and 22*a* until the pressing stroke reaches the maximum load position P1. Next, when the pressing stroke reaches the maximum load position P1, the dome shapes of the dome parts 21*a* and 22*a* sag as illustrated in FIG. 7B. When the operating part 40*a* is further pressed, the dome parts 21*a* and 22*a* start to be inverted. As illustrated in FIG. 7A, the operating load becomes maximum at the maximum load position P1, and decreases when the operating part 40*a* is further pressed and the dome parts 21*a* and 22*a* start to be inverted. As a result, the operator pressing the operating part 40*a* gets a feel that the switch is pushed in. When the operator continues to press the operating part 40*a*, the pressing stroke reaches the inversion completion positon P2. At the inversion completion position P2, the inversion of the dome parts 21*a* and 22*a* is completed and as illustrated in FIG. 7C, only the tongue part 21*d*, which protrudes toward the inside of the dome part 21*a* from a position near the top part 21*c* of the dome part 21*a* and is shaped like a plate spring, elastically contacts the first fixed contact 10*a*. As a result, the tongue part 21*d* functions as the contact part 20*d* that can elastically contact the first fixed contact 10*a*, and the first fixed contact 10*a* is electrically connected via the movable contact 20 to the second fixed contacts 10*b*. That is, the switch is turned on.

In the push switch 1 of the present embodiment, the first fixed contact 10*a* is disposed such that the dome parts 21*a* and 22*a* (dome-shaped parts other than the tongue part 21*d*) do not contact the first fixed contact 10*a* when the inversion of the dome parts 21*a* and 22*a* is completed. Therefore, the dome parts 21*a* and 22*a* contact the first fixed contact 10*a* after an inflection point at which the decreased operating load starts to increase again. More specifically, the fixed contact 10 is arranged in the housing 50 such that the first fixed contact 10*a* is shifted in the Z2 direction relative to the second fixed contacts 10*b*. With this configuration, at the timing when the inversion of the dome parts 21*a* and 22*a* is completed, as illustrated in FIG. 7C, the top part 21*c* of the dome part 21*a* is not in contact with the first fixed contact 10*a*, and only the tongue part 21*d*, which is shaped like a plate spring and elastically deformable, is in contact with the first fixed contact 10*a*. The protruding length of the tongue part 21*d* is preferably set such that the tongue part 21*d* contacts the first fixed contact 10*a* slightly before the pressing stroke reaches the inversion completion position P2. This enables the tongue part 21*d* to reliably contact the first fixed contact 10*a* due to elasticity when the inversion of the dome parts 21*a* and 22*a* is completed, and enables stable electric connection.

When the operating part 40*a* is further pressed, as illustrated in FIG. 7D, the tongue part 21*d* is caused to firmly contact the first fixed contact 10*a* and the top part 21*c* of the dome part 21*a* contacts the first fixed contact 10*a* at the predetermined pressing stroke position P3 of the pressing stroke. After this state, the operating load sharply increases.

To further clarify the above features of the push switch 1, operations of a related-art push switch of a comparative example are described below.

As illustrated by FIG. 8A, with the related-art push switch of the comparative example, the operating load felt by the operator increases, decreases, and then sharply increases as the position of the pressing stroke changes.

As illustrated in FIG. 8B, the push switch of the comparative example includes a movable contact A20 that includes dome parts A21*a* and A22*a* that are shaped like a dome and can be inverted in shape when pressed. In the initial state, the dome parts A21*a* and A22*a* are apart from a first fixed contact A10*a*. Skirts A21*b* and A22*b* are in contact with second fixed contacts A10*b*. The first fixed contact A10*a* is disposed at the same height as the second fixed contacts A10*b* such that a top part A21*c* contacts the first fixed contact A10*a* in the middle of inversion of the dome parts A21*a* and A22*a*. With this configuration, the dome parts A21*a* and A22*a* sag at a maximum load position PA1 as illustrated in FIG. 8C. When further pressed, as illustrated in FIG. 8D, the dome parts A21*a* and A22*a* contact the first fixed contact A10*a* at a contact position PA3 in the middle of the inversion of the dome parts A21*a* and A22*a*. As illustrated in FIG. 8A, the push switch is configured such that the pressing stroke amount at the contact position PA3 is smaller than the pressing stroke amount at a virtual inversion completion position PA2 at which the inversion of the dome parts A21*a* and A22*a* is supposed to be completed. With this configuration, the dome parts A21*a* and A22*a* reliably contact the first fixed contact A10*a* in the middle of inversion, and the push switch is turned on. In this state, the dome parts A21*a* and A22*a* firmly contact the first fixed contact A10*a*, and the operating load sharply increases.

The related-art push switch of the comparative example has a problem where a sound is generated when the push switch is turned on. This problem is assumed to be cause by the reasons described below.

The dome parts A21*a* and A22*a* start to be inverted while storing kinetic energy that is generated by elastic deformation (see FIG. 8B) immediately before the inversion. For this reason, when the dome parts A21*a* and A22*a* collide with the first fixed contact A10*a* before the inversion is completed, the stored kinetic energy is converted into collision energy. This increases the collision sound generated when metal parts collide with each other. When the thickness of the dome parts A21*a* and A22*a* is reduced so that the dome parts A21*a* and A22*a* can be elastically deformed more easily and the collision sound can be reduced, the amount of change in the operating load also becomes small and the click feel is reduced. Also, when the operating load necessary to invert the dome parts A21*a* and A22*a* is increased to achieve a clearer click feel by, for example, increasing the thickness of the dome parts A21*a* and A22*a*, the kinetic energy generated by elastic deformation increases, and the collision sound generated when the dome parts A21*a* and A22*a* collide with the first fixed contact A10*a* increases.

The above problems of the related-art configuration are solved by the push switch 1 of the present embodiment. In the present embodiment, the operating load necessary to invert the dome parts 21*a* and 22*a* is increased to achieve a clearer click feel by, for example, increasing the thickness of the dome parts 21*a* and 22*a*; and the first fixed contact 10*a* is placed in such a position that the top part 21*c* of the dome part 21*a* does not contact the first fixed contact 10*a* at the timing when the inversion of the dome parts 21*a* and 22*a* is completed. With this configuration, the kinetic energy generated by elastic deformation immediately before the inversion and stored in the dome parts 21*a* and 22*a* is used for thermal energy (e.g., vibration) after the inversion is completed. In the push switch 1 of the present embodiment, the tongue part 21*d* shaped like a plate spring is provided as the contact part 20*d* that contacts the first fixed contact 10*a*. In the push switch 1, the spring constant of the contact part 20*d* (the tongue part 21*d*) is less than the spring constant of the dome parts 21*a* and 22*a*. Although the tongue part 21*d* contacts the first fixed contact 10*a* before the inversion of the dome parts 21*a* and 22*a* is completed, the collision sound is small because the tongue part 21*d* has a small spring constant and is elastically deformed easily. After the tongue part 21*d* contacts the first fixed contact 10*a*, the elasticity of the tongue part 21*d* functions as a cushion and reduces the impact generated when the dome part 21*a* is pressed to a position at which the dome part 21*a* contacts the first fixed contact 10*a*. As described above, the configuration of the push switch 1 of the present embodiment makes it possible to prevent the kinetic energy, which is generated while the dome parts 21*a* and 22*a* are inverted, from being added to collision energy with which the dome part 21*a* contacts the first fixed contact 10*a*. Thus, the present embodiment provides a push switch with a good operation feel as well as a small operation sound.

In the push switch 1 of the present embodiment, the first fixed contact 10*a* is placed in such a position that the amount of pressing stroke up to the predetermined position P3 is 1.1 to 1.2 times greater than the amount of pressing stroke up to the inversion completion position P2 at which the inversion of the dome parts 21*a* and 22*a* is completed. It is possible to reduce the collision sound by setting the predetermined position P3 at which the dome part 21*a* contacts the first fixed contact 10*a* such that the amount of pressing stroke up to the predetermined position P3 becomes steadily greater than the amount of pressing stroke up to the inversion completion position P2 at which the inversion of the dome part 21*a* is completed. Further, the present embodiment makes it possible to reduce the odd feeling that is felt when the amount of pressing stroke necessary after the inversion is too large.

Because the related-art push switch of the comparative example needs to be configured such that the dome parts A21*a* and A22*a* collide with the first fixed contact A10*a* while being inverted, it is difficult to design and manufacture the movable contact 20. The push switch 1 of the present embodiment can be designed and manufactured by adjusting the sizes of the skirt 21*b* and the tongue part 21*d* as necessary. Thus, the push switch 1 can be easily optimized to achieve a desired operation feel and a desired operation sound. Also, the ON timing at which the switch is electrically turned on can be adjusted to match a pressing stroke position at which a click feel is obtained.

Next, effects of the present embodiment are described.

The push switch 1 of the present embodiment includes the movable contact 20 including the dome part 21*a* that is shaped like a dome and can be inverted in shape when pressed, and the fixed contact 10 including the first fixed contact 10*a*. The movable contact 20 is configured to be brought into contact with and away from the first fixed contact 10*a*. After the movable contact 20 starts to be pressed, the operating load necessary to press the movable contact 20 gradually increases. Then, the operating load decreases when the dome part 21*a* is inverted, and increases again when the movable contact 20 is pressed further. The dome part 21*a* contacts the first fixed contact 10*a* after an inflection point at which the decreased operating load starts to increase again.

With this configuration, the dome part 21*a* contacts the first fixed contact 10*a* after an inflection point at which the decreased operating load starts to increase again, i.e., after the inversion is completed and the kinetic energy is reduced. This in turn makes it possible to reduce the collision energy with which the movable contact 20 collides with the first fixed contact 10*a* and thereby reduce the collision sound (operation sound).

The movable contact 20 is disposed such that the dome part 21*a* contacts the first fixed contact 10*a* when the movable contact 20 is pressed further to the predetermined pressing stroke position P3 from the inversion completion position P2 at which the inversion of the dome part 21*a* is completed.

This configuration makes it possible to prevent the kinetic energy, which is generated while the dome part 21*a* is inverted, from being added to the collision energy and thereby makes it possible to reduce the collision sound.

The first fixed contact 10*a* is preferably placed in such a position that the amount of pressing stroke up to the predetermined position P3 is 1.1 to 1.2 times greater than the amount of pressing stroke up to the inversion completion position P2 at which the inversion of the dome part 21*a* is completed.

This configuration makes it possible to set the predetermined position P3 at which the dome part 21*a* contacts the first fixed contact 10*a* such that the amount of pressing stroke up to the predetermined position P3 becomes steadily greater than the amount of pressing stroke up to the inversion completion position P2 at which the inversion of the dome part 21*a* is completed, and thereby makes it possible to reduce the collision sound. Further, this configuration makes it possible to reduce the odd feeling that is felt when the amount of pressing stroke necessary after the inversion is too large.

Also, the movable contact 20 of the push switch 1 of the present embodiment includes the contact part 20*d* configured to elastically contact the first fixed contact 10*a* of the fixed contact 10 at a pressing stroke position up to the inversion completion position P2 at which the inversion of the dome part 21*a* is completed.

This configuration makes it possible to adjust the ON timing such that the switch is electrically turned on at a pressing stroke position that is before the pressing stroke position at which the dome part 21*a* contacts the first fixed contact 10*a*.

The movable contact 20 of the push switch 1 of the present embodiment preferably includes the skirt 21*b* that continuously surrounds and extends outward from the circumference of the dome part 21*a* and the tongue part 21*d* that is shaped like a plate spring and protrudes toward the inside of the dome part 21*a*.

This configuration makes it possible to adjust the ON timing such that only the tongue part 21*d* contacts the first fixed contact 10*a* when the inversion of the dome part 21*a* is completed.

Also, the push switch 1 of the present embodiment is configured such that the spring constant of the contact part 20*d* is less than the spring constant of the dome part 21*a*.

This configuration makes it possible to make the collision energy less than the collision energy of the dome part 21*a* being inverted, and thereby makes it possible to reduce the collision sound of the contact part 20*d*.

The push switch 1 according to an embodiment of the present invention is described above. However, the present invention is not limited to the specifically disclosed embodiment, and variations and modifications may be made without departing from the scope of the present invention. For example, variations of the push switch 1 described below are also within the scope of the present invention.

Figure 9:
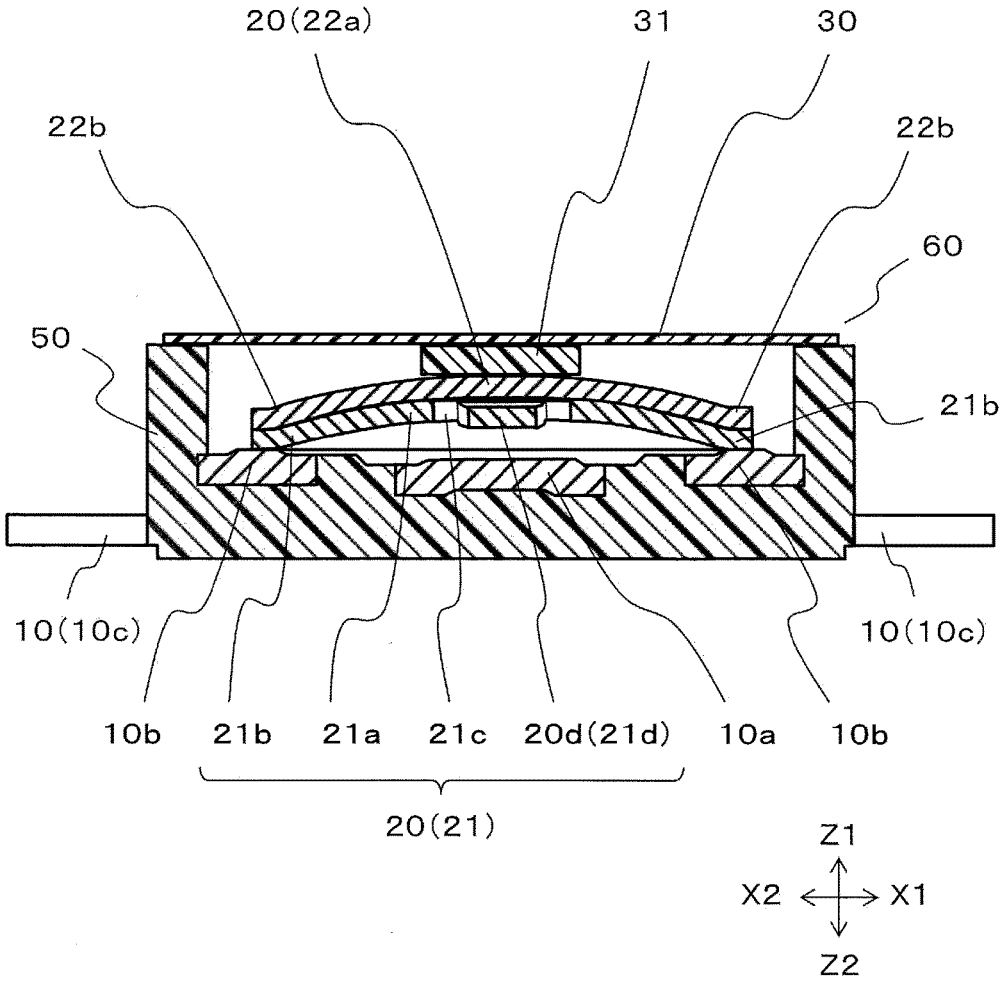
FIG. 9 is a cross-sectional view of a variation of a push switch.
Figure 10:
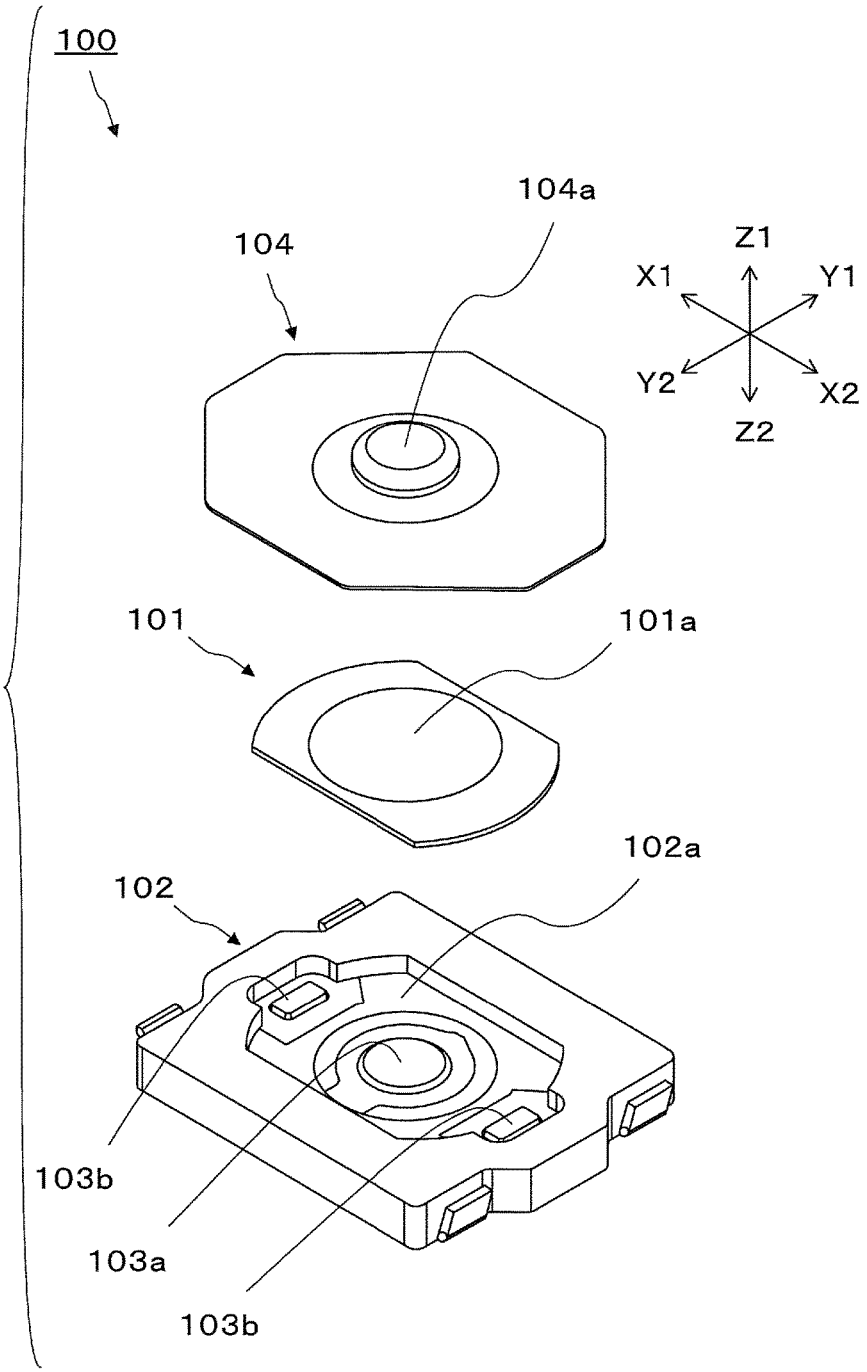
FIG. 10 is an exploded perspective view of a related-art push switch.
Figure 11A:
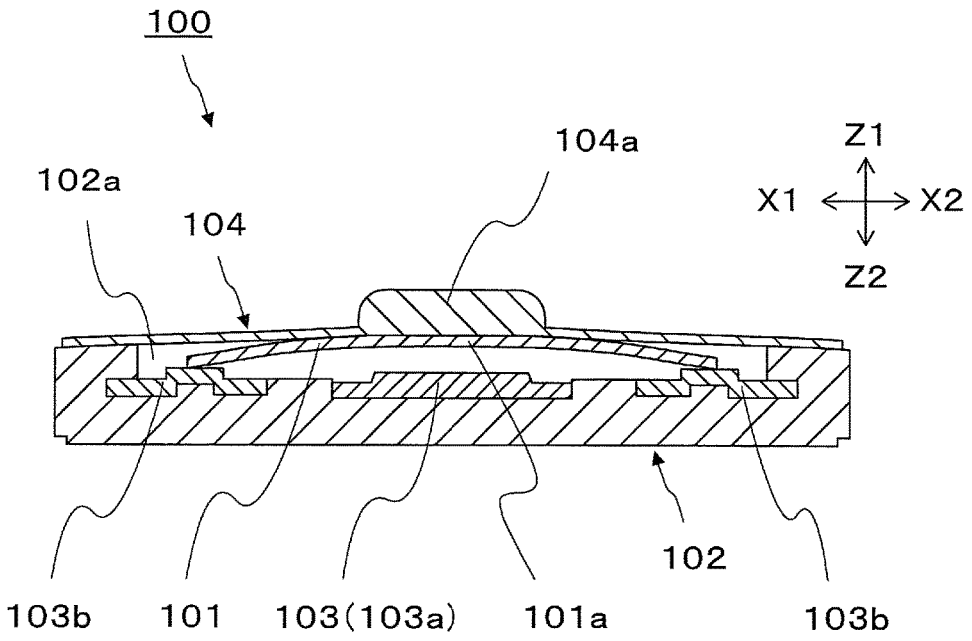
FIG. 11A is a cross-sectional view of a related-art push switch that is not being pressed.
Figure 11B:
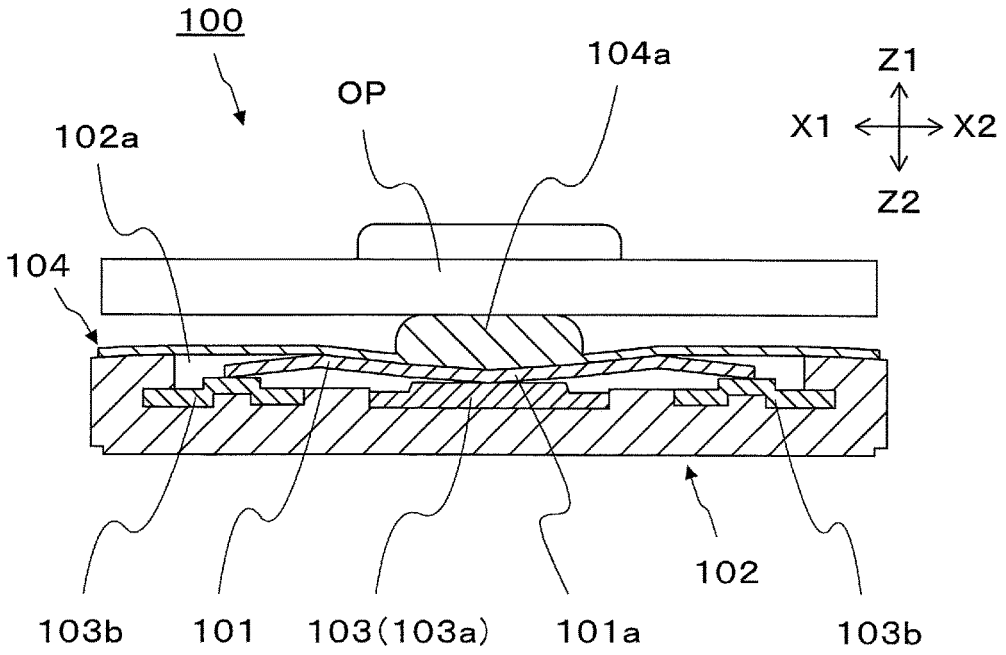
FIG. 11B is a cross-sectional view of the related-art switch that is being pressed.

(1) In the above embodiment, the push switch 1 includes the operation part 40 and the cover 60. However, the push switch 1 may have a simpler configuration. FIG. 9 is a cross-sectional view of a variation of a push switch with a simpler configuration. In the variation of the push switch, the periphery of the sheet 30 is attached to the upper surface of the side wall of the housing 50, and a pressed part 31 is attached to a portion of the sheet 30 that is brought into contact with the movable contact 20. Other components of the push switch are the same as those illustrated in FIG. 4. The same reference numbers as those in FIG. 4 are assigned to those components, and their descriptions are omitted here. When the sheet 30 is pressed, the dome parts 21*a* and 22*a* of the movable contact 20 are inverted in shape, and the tongue part 21*d* provided at the top 21*c* contacts the first fixed contact 10*a* as the contact part 20*d*. This configuration provides the same advantageous effects as those of the above embodiment.

(2) In the above embodiment, the first fixed contact 10*a* is shifted in the Z2 direction relative to the second fixed contacts 10*b* so that the dome parts 21*a* and 22*a* do not collide with the first fixed contact 10*a* at the timing when the inversion of the dome parts 21*a* and 22*a* is completed. Alternatively, the shape of the movable contact may be changed. For example, a first fixed contact and second fixed contacts of a fixed contact may be disposed at the same height in the Z1-Z2 direction, and a skirt of a movable contact may be configured to protrude in the Z2 direction so that a dome part does not contact the first fixed contact at the timing when the inversion of the dome part is completed.

(3) In the above embodiment, the contact part 20*d* is provided in the movable contact 20. Alternatively, a contact may be provided in the fixed contact 10.

(4) In the above embodiment, the movable contact 20 includes the first movable contact 21 and the second movable contact 22 that are stacked on each other. Alternatively, the movable contact 20 may include only the first movable contact 21.

What is claimed is:

1. A push switch, comprising:

a movable contact including a dome part that is shaped like a dome and configured to be inverted in shape when pressed; and a fixed contact including a first fixed contact, the movable contact being configured to be brought into contact with and away from the first fixed contact, wherein the movable contact includes a contact part that is configured to elastically contact the fixed contact at a pressing stroke position up to an inversion completion position at which the inversion of the dome part is completed;

the push switch is configured such that an operating load necessary to press the movable contact gradually increases after the movable contact starts to be pressed, decreases thereafter when the dome part is inverted, and increases again when the movable contact is further pressed, the contact part contacts the fixed contact and the movable contact is electrically connected to the first fixed contact before an inflection point at which the decreased operating load starts to increase again, and the dome part contacts the first fixed contact after the inflection point;

the movable contact is disposed such that the dome part contacts the first fixed contact when the movable contact is pressed further to a predetermined pressing stroke position from the inversion completion position; and the first fixed contact is placed in such a position that an amount of pressing stroke up to the predetermined pressing stroke position is 1.1 to 1.2 times greater than an amount of pressing stroke up to the inversion completion position at which the inversion of the dome part is completed.

2. The push switch as claimed in claim 1, wherein the movable contact includes the dome part, a skirt that continuously surrounds and extends outward from a circumference of the dome part, and a tongue part that is shaped like an elastically-deformable plate spring and protrudes toward an inside of the dome part from a position near a top part of the dome part; and the contact part is the tongue part.

3. The push switch as claimed in claim 1, wherein a spring constant of the contact part is less than a spring constant of the dome part.

* * * * *